United States Patent [19]

Cleckler

[11] 4,397,118

[45] Aug. 9, 1983

[54] GLASS BEVELING APPARATUS

[76] Inventor: Noel Cleckler, 1457 Westmoreland St., Abilene, Tex. 79603

[21] Appl. No.: 224,201

[22] Filed: Jan. 12, 1981

[51] Int. Cl.[3] ..... B24B 9/10

[52] U.S. Cl. ..... 51/74 R; 51/240 R

[58] Field of Search ..... 51/74 R, 74 BS, 92 B, 51/92 BS, 240 R, 34 D

[56] References Cited

U.S. PATENT DOCUMENTS

| | | | |
|---|---|---|---|
| 1,512,889 | 10/1924 | Henry | 51/74 BS |
| 2,221,638 | 11/1940 | Indge | 51/92 R |
| 2,315,104 | 3/1943 | Baldenhofer | 51/92 R |
| 2,724,219 | 11/1955 | Reaser | 51/240 R |
| 3,047,987 | 8/1962 | Baldenhofer et al. | 51/92 R |
| 3,187,467 | 6/1965 | Cortesi | 51/34 D |
| 3,834,274 | 9/1974 | Dowd | 51/74 R |

*Primary Examiner*—Harold D. Whitehead

*Attorney, Agent, or Firm*—Victor J. Evans & Co.

[57] ABSTRACT

An apparatus for beveling a marginal edge of a sheet of glass which includes a table having a top opening in which a support plate for the glass sheet to be bevelled is disposed with a grinding wheel mounted on the table over the support plate, the grinding wheel being fixed to a shaft drivably connected by a belt to a drive motor on the table and the shaft being rotatably mounted in bearings supported on an adjustment device mounted on the table by means of which the horizontal, vertical and angular positions of the shaft and therefore the grinding wheel may be set together with a guide on a support plate which the marginal edge of the glass sheet to be bevelled engages as the glass sheet is moved slidably on the support plate with the glass sheet marginal edge in grinding engagement with the peripheral edge of the grinding wheel.

9 Claims, 2 Drawing Figures

GLASS BEVELING APPARATUS

BACKGROUND OF THE INVENTION

It is frequently desirable to provide a beveled edge on a sheet of glass for many purposes and various machines have been proposed in the past for forming such a beveled edge on a glass sheet with the use of a grinding wheel or the like. However, such present day machines are designed for relatively large sheets of glass usually with straight edges wherein the quality of the bevel need meet only minimum standards with respect to such features such as the angle of bevel, surface quality, uniformity of bevel and the like. Furthermore, the grinding wheels on such present day machines usually are characterized by a relatively short useful life and are required to be frequently replaced. In addition, finishing operations on the beveled edges formed by such present day machines require further processing such as polishing or the like adding to the capital expenditures and seriously reducing the production rate.

In many areas, relatively small sheets of glass require a bevel such as small mirrors, leaded glass and what is referred to as "art" glass wherein the bevel must meet high quality standards both from the standpoint of surface finish and uniformity as well as providing a bevel on such small glass sheets wherein the edge to be beveled has a curved or undulating configuration.

The patents which are representative of the prior art to which the subject invention pertains and which are clearly distinguishable both structurally and functionally from applicant's beveling apparatus are as follows:

U.S. Pat. No. 2,926,461, Banko;

U.S. Pat. No. 3,187,467, Cortesi.

The Cortesi patent teaches the use of a machine for beveling the edges of glass plates in which a support frame carries the drive motor and the entire structure is arranged to be pivoted to change the angle of bevel. The Banko patent teaches the use of a grinder which is angulated at 13 (FIG. 1) and the work table is moved upwardly and laterally for engagement with the grinder. Neither of these prior art patents teach the basic concept of applicant's invention.

OBJECTS AND SUMMARY OF THE INVENTION

Accordingly, a primary object of this invention is to provide a new and novel apparatus for grinding a bevel of high quality and uniformity on small sheets of glass.

Another object of this invention is to provide a new and novel glass beveling machine for beveling small glass sheets of the type utilized by art glass studios, leaded glass shops and the like where a selected angle of bevel within a wide range may be formed within extremely close tolerances.

A further object of this invention is to provide a new and novel machine for beveling the edge of a sheet of glass which may be straight or curved, which is characterized by high production rate and which enables prolonged use of a grinding wheel without replacement.

Still another object of this invention is to provide a new and novel apparatus for beveling the edge of small sheets of glass which provides for ready disposal of glass grindings and for the drainage of coolant during the beveling operation and which is relatively inexpensive and simple in construction and which may be utilized by a relatively unskilled individual without loss in bevel quality.

The object of the invention and other related objects are accomplished by the provision of a frame on which a grinding wheel is rotatably mounted on a horizontal axis with drive means connected to the grinding wheel mounted on the frame for rotating the grinding wheel. Means are provided on the frame for rotatably supporting the grinding wheel which may be adjusted horizontally, vertically and angularly so as to permit the grinding wheel to be positioned in a selected grinding position independent of the drive means. A substantially planar support plate is provided on the frame in underlying relationship with the peripheral edge of the grinding wheel for slidably supporting a sheet of glass to be bevelled and a guide member is provided on the upper surface of the support plate for guiding engagement with a marginal edge of the sheet of glass during the sliding movement of the sheet of glass on the support plate with the grinding wheel in beveling engagement with the marginal edge of the glass sheet.

Other objects and advantages will become apparent in the following specification when considered in light of the attached drawings.

DESCRIPTION OF THE PREFERRED EMBODIMENT

Figure 1:
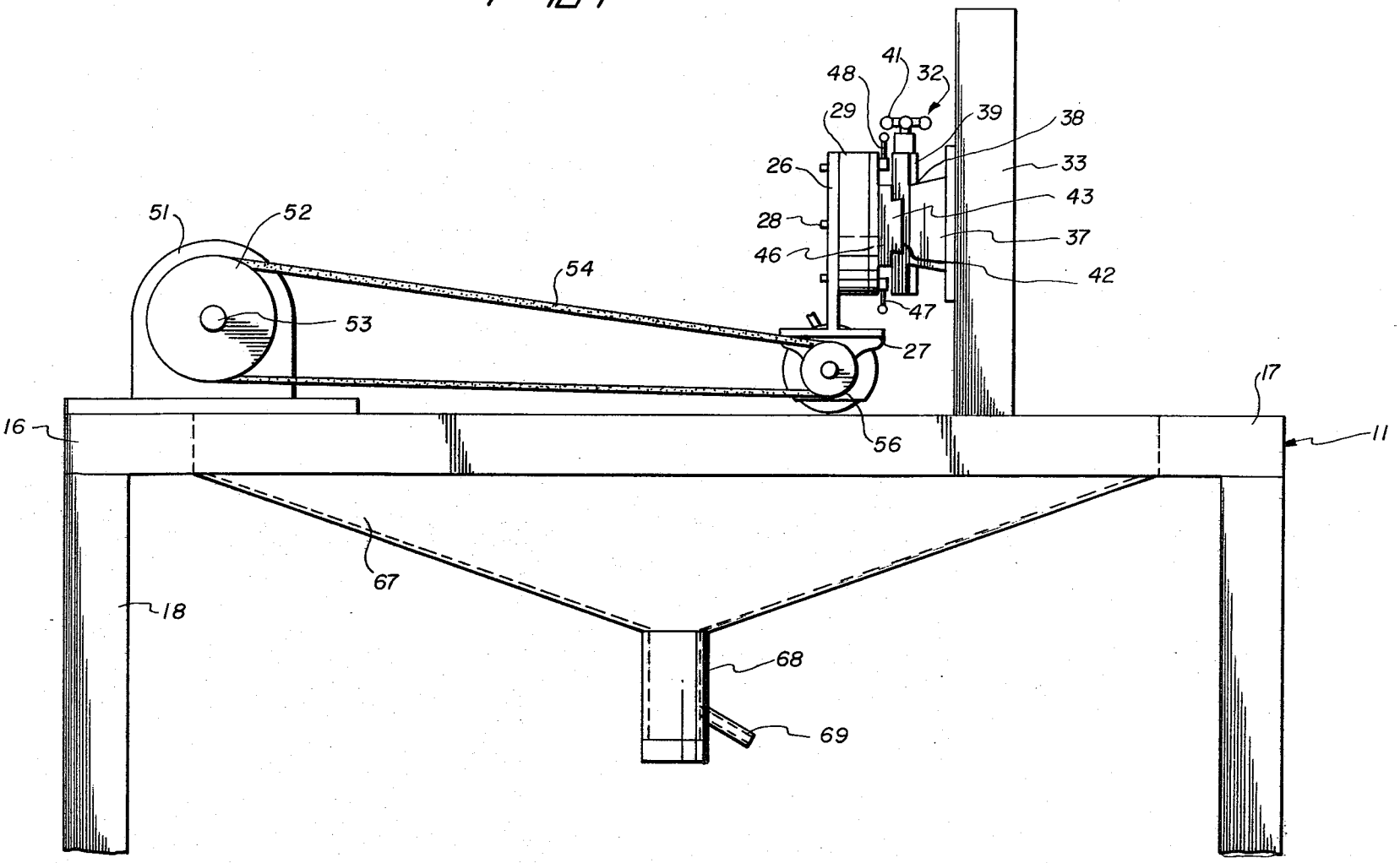
FIG. 1 is a side elevation view of the beveling apparatus of the invention.

Referring now to the drawings the glass beveling apparatus of the invention includes a frame such as a table 11 having an upper portion formed by side members 12, 13 and end members 16, 17 arranged in a substantially rectangular configuration and supported on a plurality of legs 18 in an elevated position. Thus, the side members 12, 13 and end members 16, 17 define an open area 19 as shown best in FIG. 2 over which is disposed means on the table 11 for supporting a grinding wheel 21 for axial rotation. The grinding wheel 21 is of the type suitable for beveling the marginal edge of a sheet of glass designated generally in FIG. 2 by the letter G.

The grinding wheel 21 is preferably of conventional type having an outer peripheral **21*a* in which diamond particles are embedded for the initial grinding operation. By way of example the wheel 21** may be a 320 grit wheel.

The wheel 21 is suitably mounted adjacent the end of a shaft 22 rotatably supported in bearings 23, 24 which are pivotally attached in laterally spaced relationship on a plate 26 of T-shaped configuration having a pair of feet 27. The support plate 26 is suitably attached by means such as bolts 28 to a support disc 29 the bearings 23, 24 being attached by means such as bolts 31 to the plate feet 27.

The support disc 29 is arranged to be adjustably mounted for movement into a selected rotary position on slide means designated generally in FIG. 1 by the reference numeral 32 suitably secured to an upstanding support bracket 33 mounted on the upper portion of the table 11 whereby the horizontal and vertical position of the shaft 22 and therefore the grinding wheel 21 may be adjusted.

Figure 2:
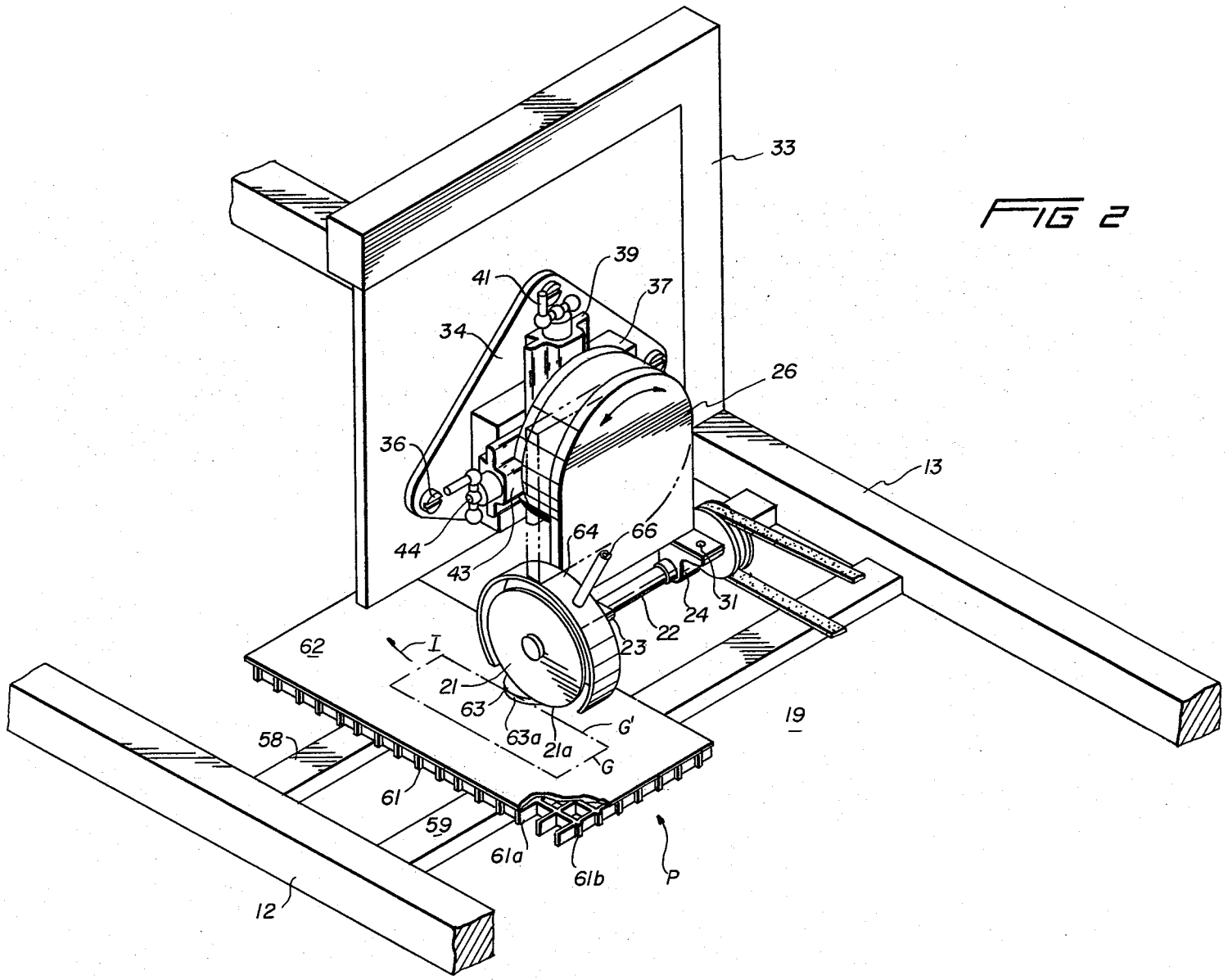
FIG. 2 is a perspective view of the upper portion of the beveling apparatus of the invention.

As shown best in FIG. 2, the upstanding bracket 33 is suitably supported on the side frame member 13 and the adjusting mechanism 32 is secured to one face of the bracket 33 by means of a plate 34 utilizing screws 36. A slide block 37 is suitably mounted on the plate 34 and is provided with a vertically extending groove 38 for accommodating a vertically adjustable slide member 39 movable into an adjusted vertical position and clamped therein by means of a hand crank 41. The slide member 39 includes a horizontally extending groove 42 for accommodating a horizontally movable slide member 43 which may be clamped in a selected horizontal position by means of a hand crank 44. The slide member 43 is suitably secured to a support plate 46 for supporting the support disc 29 and to which the support disc 29 may be clamped in the selected rotary position by means such as hand clamps 47, 48. Thus, the sliding movement of the slide member 39, the slide member 43 and the rotary movement of the support disc 29 permits the grinding wheel shaft 22 and therefore the grinding wheel 21 to be adjusted into a selected vertical position, horizontal position and angular position respectively for the beveling operation on the marginal edge of the sheet of glass G.

The beveling apparatus of the invention includes drive means on the table 11 for rotating the grinding wheel 21 in any selected adjusted position of the grinding wheel. More specifically, a drive motor 51 which is preferably an electric motor is suitably mounted on the upper portion of the table 11 such as the corner of the table defined by the end frame member 16 and side frame member 13. The motor 51 is provided with a pulley 52 on its output shaft 53 connected by means of a belt 54 to a pulley 56 mounted on the shaft 22. The use of a belt 54 permits the shaft 22 to be moved during the adjustment of the position of the shaft 22 and grinding wheel 21 while maintaining the driving connection between the motor pulley 52 and the shaft pulley 56.

The beveling apparatus of the invention includes a substantially planar support plate designated generally in FIG. 2 by the letter P which is arranged to slidably support the sheet of glass G during the beveling operation. The support plate P is disposed in underlying relationship with the peripheral edge 21*a* of the grinding wheel 21 within the opening 19 of the table 11 and is preferably disposed on a pair of transverse members 58, 59 mounted at their ends on the side frame members 12, 13 as shown in FIG. 2. In the illustrated embodiment, the support plate P includes a base plate 61 of rigid material preferably in the form of a grid having transverse and longitudinal strips 61*a*, 61*b* respectively. A sheet 62 of flexible material such as rubber or the like is positioned on the upper surface of the base plate 61 which is arranged to slidably accommodate the sheet of glass G as it is moved in the direction of the arrow I during the beveling operation.

A guide member 63 is provided on the upper surface of the support plate P and more specifically on the base plate 61, the guide member 63 comprising a disc having a peripheral edge 63*a* against which the marginal edge G' of the sheet of glass G to be bevelled is guided during such sliding movement on the support plate P.

Means are provided for cooling the grinding the wheel 21 during the beveling operation which, in the illustrated embodiment, includes a shroud 64 surrounding the back and peripheral edge 21*a* of the grinding wheel 21 in spaced relationship therewith and connected by means of a conduit 66 to source of coolant (not shown) which may be a mixture of water and and a diamond wheel coolant. As can be understood, the coolant is pumped by suitable means through the conduit 66 through the shroud 64 onto the surface of the grinding wheel 21 during the grinding operation thereby preventing a temperature rise in the wheel which would otherwise shorten the wheel life.

Means are provided on the beveling apparatus of the invention for collecting and disposing of the coolant as well as the glass particles formed by the beveling operation which includes a funnel-shaped pan 67 the upper edges of which are secured to the upper portion of the table 11 so as to extend below the opening 19 in the table. The pan 67 includes an outlet spout 68 having an auxiliary outlet 69 by means of which the glass grit and coolant may be conducted to a suitable collection device such as a tank or the like.

In the operation of the beveling apparatus of the invention, the horizontal, vertical and angular position of the shaft 22 and therefore the grinding wheel 21 is adjusted as explained above so that the desired angle of bevel as well as the bevel width is established. In the apparatus of the invention, the degree of bevel may range from 0 up to 20 degrees or more and the bevel may be as wide as 1 7/16 inches. Preferably, the initial beveling operation is carried out with a 320 grit grinding wheel 21 but following this initial beveling operation, it is desirable to utilize a finer grit wheel such as a 600 grit wheel.

With the coolant following into the shroud 64, the sheet of glass G to be bevelled is placed on the support plate P with its marginal edge G' against the peripheral edge 63*a* of the guide 63. The glass sheet G is then moved in the direction of the arrow I in grinding engagement with the wheel peripheral surface 21*a* in a first grinding pass. Preferably, subsequent grinding passes are performed on the glass sheet G as the first pass should grind the bevel about ⅛ inch in width. The vertical position of the grinding wheel 21 is then lowered about 0.002 to 0.003 inches and a second grinding pass made under the grinding wheel 21 until the bevel formed on the glass marginal edge G' is approximately 7/16 inches wide if the bevel is to be ½ inch. At this point the finer grit grinding wheel may be used with subsequent grinding passes made following which polishing of the bevelled edge may be accomplished on a felt wheel machine.

Having thus described the preferred embodiment of the invention it should be understood that numerous structural modifications and adaptations may be resorted to without departing from the spirit of the invention.

What is claimed is:

1. An apparatus for manually beveling a sheet of glass comprising, in combination, a frame, a grinding wheel, means for supporting said grinding wheel on said frame for axial rotation, drive means on said frame for rotating said grinding wheel said drive means including a motor means remotely spaced from said grinding wheel and connected thereto by belt means, a substantially planar support plate disposed on said frame in underlying relationship with a peripheral edge of said grinding wheel for slidably supporting a sheet of glass to be beveled, means for adjusting the axial position of said grinding wheel relative to said support plate, a guide member on the upper surface of said support plate for guiding engagement with a marginal edge of said sheet of glass during sliding movement of said sheet of glass on said support plate with said grinding wheel peripheral edge in grinding engagement with the marginal edge of said glass sheet to thereby provide a beveled marginal edge on said glass sheet during said sliding movement. wherein said support plate comprises a substantially rectangular grid member of rigid material and a cover member of elastomeric material disposed on the upper surface of said grid member and wherein said guide member is substantially disc shaped having a peripheral edge adapted to engage the edge of the glass sheet to be beveled.

2. An apparatus in accordance with claim 1 wherein said means for supporting said grinding wheel comprises a shaft drivably connected to said drive means, through said belt means and means for rotatably supporting said shaft on said adjusting means to permit the horizontal, vertical and angular positions of said shaft with said grinding wheel thereto be adjusted.

3. An apparatus in accordance with claim 2 wherein said adjustable means includes an upstanding support bracket on said frame, a support disc, slide means for mounting said support disc on said bracket for positioning said support disc in a selected vertical and horizontal position on said support bracket, means for adjusting the rotary position of said support disc and means for supporting said shaft on said support disc for adjusting the angular position of said shaft in accordance with the desired degree of bevel on said sheet of glass.

4. An apparatus in accordance with claim 3 wherein said drive means further includes a pulley assembly for drivably connecting said motor means to said shaft through said belt means for rotating said shaft with said grinding wheel thereon in a selected hoorizontal, vertical and angular position of said shaft.

5. An apparatus in accordance with claim 4 wherein said slide means comprises a vertically extending channel member on said support bracket, a vertically extending slide member slidably disposed in said vertically extended channel member, a horizontally extending channel in said vertically extending slide member, a horizontally extending slide member slidably disposed in said horizontally extending channel and means for clamping said horizontally and vertically extending slide members in said respective channels for adjusting the horizontal and vertical positions on said shaft with said grinding wheel thereon.

6. An apparatus in accordance with claim 5 wherein said means for supporting said shaft on said support disc includes a support plate mounted on said support disc, a pair of laterally spaced bearings on said support plate for rotatably supporting said shaft and means for clamping said support disc in a selected rotary position on said horizontally extending slide member to adjust the angular position of said shaft.

7. An apparatus in accordance with claim 6 including a shroud disposed in surrounding, spaced-apart relationship with a major portion of said grinding wheel peripheral edge and means for introducing a cooling fluid into the interior of said shroud in heat transfer relationship with said grinding wheel peripheral edge.

8. An apparatus in accordance with claim 7 wherein said frame comprises a table having upper, side and end frame members defining an opening and means for supporting said support plate within said opening in said underlying relationship with said grinding wheel peripheral edge to permit said cooling fluid and glass particles formed during the grinding of said glass sheet marginal edge to fall downwardly through said opening.

9. An apparatus in accordance with claim 8 including a pan supported on said table below said opening for collecting said cooling fluid and said glass particles and means connected to said pan for conducting said cooling fluid and said glass particles to a remote location.

* * * * *